United States Patent [19]

Winkler et al.

[11] Patent Number: 4,666,386

[45] Date of Patent: May 19, 1987

[54] ROTARY PUMP

[75] Inventors: Otmar Winkler, Schweinfurt; Heinz Peter, Dittelbrunn; Manfred Krug, Schweinfurt; Siegbert Kessler, Oerlenbach; Ludwig Feuerer, Gochsheim, all of Fed. Rep. of Germany

[73] Assignee: SKF GmbH, Schweinfurt, Schweinfurt, Fed. Rep. of Germany

[21] Appl. No.: 769,584

[22] Filed: Aug. 26, 1985

[30] Foreign Application Priority Data

Aug. 29, 1984 [DE] Fed. Rep. of Germany ..... 3431719

[51] Int. Cl.[4] ..... F04C 18/00

[52] U.S. Cl. ..... 418/267; 267/155; 188/290; 188/307

[58] Field of Search ..... 418/266, 267; 267/58, 267/155; 188/290, 307

[56] References Cited

U.S. PATENT DOCUMENTS

| | | | |
|---|---|---|---|
| 481,303 | 8/1892 | Hamlin | 267/58 |
| 602,334 | 4/1898 | Kessler | 418/266 |
| 762,539 | 6/1904 | Leiman | 418/266 |
| 1,654,005 | 12/1927 | Luxmore | 418/266 |
| 2,463,118 | 3/1949 | Moore | 418/266 |
| 4,483,511 | 11/1984 | Kushida | 267/155 |

FOREIGN PATENT DOCUMENTS

| | | | |
|---|---|---|---|
| 3412971 | 10/1985 | Fed. Rep. of Germany | 418/267 |
| 18489 | 1/1982 | Japan | 418/266 |

*Primary Examiner*—Carlton R. Croyle
*Assistant Examiner*—Jane E. Obee
*Attorney, Agent, or Firm*—Eugene E. Renz, Jr.

[57] ABSTRACT

A rotary pump has a housing 1 with a driven rotor 7 installed in the housing 1. Vanes 12 are connected around the periphery of the rotor 7. Helical springs 14 are supported against rotor 7, which, acting on an inner surface of vanes 12, press the free end of the vanes 12 against the bore 6 of the housing 1. Each spring 14 has two coaxial sections of turns which spiral in opposite directions so that the springs 14 press the vanes 12 against the bore 6 of the housing 1 without tilting. These sections of turns are each designed with an adjacent support end 21 on the outer or inner section and a bail section, which is arranged between the inner and outer end of the sections of turns, connecting the inner and outer ends of these sections of turns rigidly together, and which projects radially beyond the sections of turns. The two support ends 21 or the bail section of the helical spring 14 are on a support surface 24 of the rotor 7, and the bail section or the support ends 21 pointing toward the free end of the vane 12 are arranged elastically to press against the inner surface of the vane 12.

6 Claims, 10 Drawing Figures

ROTARY PUMP

FIELD OF THE INVENTION

The present invention relates to rotary pumps comprising a driven rotor mounted in the bore of the housing having pivotally mounted vanes connected to the periphery of the rotor and biasing means for urging the free ends of the vanes against the bore of the housing during operation of the rotor. More specifically, the present invention relates to an improved mounting means for the vanes of rotary pumps.

BACKGROUND OF THE INVENTION

Rotary pumps of the type described above are not new per se. For example, U.S. Pat. No. 2,011,451 discloses a pump utilizing helical wire compression springs acting on each vane which have a generally radially extending axis. This known rotary pump has certain disadvantages and drawbacks. For example, it has been found that the springs for each vane adjacent each other in the axial direction exert a non-uniform pressure against the bore of the housing, that is, angularly as a result of normal, unavoidable production tolerances in the spring support surfaces. Additionally, it is noted that the springs consume a relatively large amount of space in the radial direction which produces an unfavorable reduction in the associated pump space for housing the springs. Additionally, the springs of the known rotary pump are difficult to install and insert in recesses or pockets in the vane.

SUMMARY OF THE INVENTION

With the foregoing in mind, it is an object of the present invention to provide a rotary pump characterized by novel features of construction and arrangement which overcomes the disadvantages and drawbacks of prior known assemblies. To this end, in accordance with the present invention, the vane biasing means comprises a spring having coils circumscribing the pivotal axis of the vane wherein the axis of the coil turns extend in the direction of the pivot axis of the vane, the spring being formed by two coaxial sections of turns which spiral in opposite directions. Each section of turns has a support end at the outer or inner end in a common direction and by a bail section between the inner and outer ends of the turn sections. The bail section connects the inner and outer ends of the turn sections rigidly together and projects radially beyond the turn sections. The support ends or the bail section are oriented so as to elastically press on a support surface of the rotor and the bail section or the support ends of the other turn section point toward the free end of the associated vane elastically pressing against the inner surface of the vane. By this construction, the vanes press against the bore of the housing without tilting at an angle. The biasing arrangement also facilitates compactness of design, particularly in the radial direction which can be manufactured and assembled in a highly economical manner.

Further, in accordance with the design of the present invention, a single spring is sufficient to press the free end of the vane uniformly against the bore in the housing to accommodate the spring, a cavity of compact dimension in the radial direction is formed between the vane and the rotor so that there is little or no reduction in the size of the pump chamber as a result of this cavity mounting configuration.

Still another feature of the present invention producing space saving is the housing of the springs between the vane and the rotor wherein the wall thickness of the vanes can be kept advantageously small by reason of the fact that the axis of the turns of the spring coincides with the pivot action of the vanes.

A still further feature of the present invention is the arrangement of the pivot action of each vane which is formed by the axis of a cylindrical section which projects beyond the inner surface of the vane and is held pivotally in a cylindrical recess in the support surface of the rotor and wherein the two turn sections of the spring are held in each case in a recess in the cylindrical section which tightly encloses the associated section of turns. This arrangement facilitates ease of manufacture and assembly of the spring and the vane. For example, if the vane is made of an elastic material such as plastic, the turn sections of the spring can be snapped into the recess in the cylindrical section of the vane to produce a self-retaining spring-vane arrangement. The spring-vane assembly can also be pivotally attached to the rotor without any additional assembly operations, for example, by pressing each cylindrical section into the associated groove-like recess of the rotor.

BRIEF DESCRIPTION OF THE DRAWINGS

These and other objects of the present invention and the various features and details of the operation and construction thereof are hereinafter more fully set forth with reference to the accompanying drawings, wherein.

DESCRIPTION OF THE PREFERRED EMBODIMENTS

Figure 1:
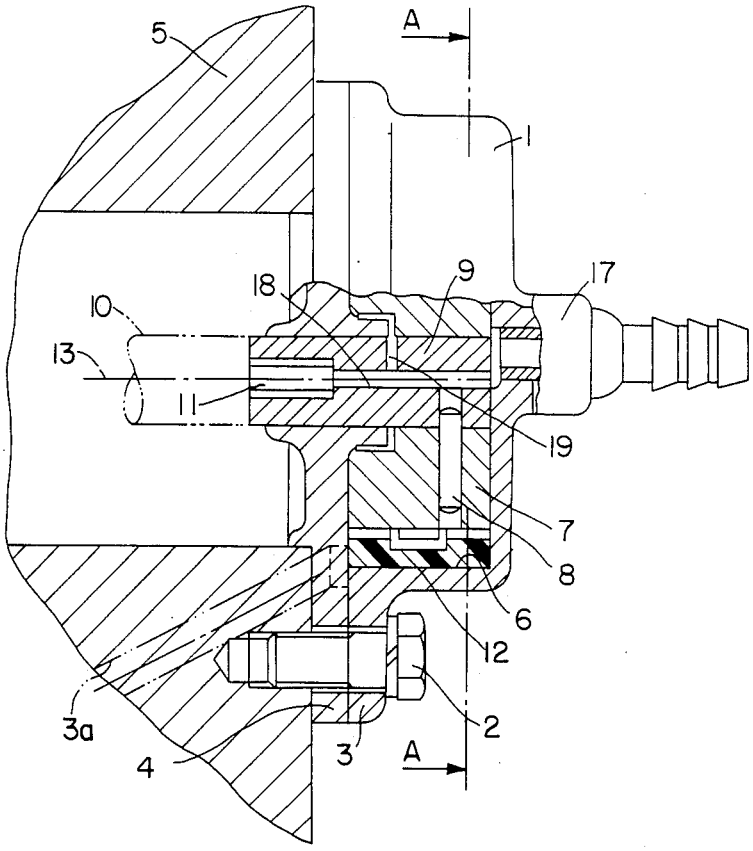
FIG. 1 is a fragmentary longitudinal section through a rotary pump in accordance with the present invention.
Figure 2:
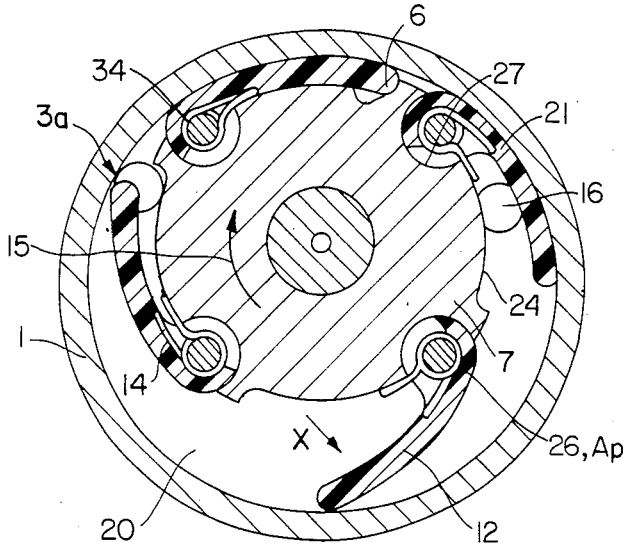
FIG. 2 is an enlarged sectional view taken on lines 2—2 of FIG. 1.

Referring now to the drawings and particularly to FIGS. 1 and 2 thereof, the reference numeral 1 designates the housing of a rotary pump made in accordance with the present invention. The pump serves as a vacuum brake pressure amplifier in the internal combustion engine of a motor vehicle (not shown). Housing 1 consists of a bell section 3 and a cover section 4 which is flanged to the engine block 5 of the internal combustion engine by means of screws 2. A rotor is mounted in the bore of the housing 1 which in the present instance is rigidly connected to a central shaft or axle 9 by means of a radially extending locking pin 8. Rotor 7 is turned by a drive shaft 10 about axis 13 as indicated in broken lines in FIG. 1, the drive shaft 10 engaging in a form-locking manner in a central axial opening 11 of polygonal cross section in axle 9. A plurality of vanes 12, in the present instance four are illustrated, made of sliding friction resistant plastic are mounted at circumferentially spaced locations around the periphery of the rotor. The inner ends of the vanes as illustrated are pivotally mounted to the rotor 7 so that they pivot about a pivot axis $A_p$.

Figure 3:
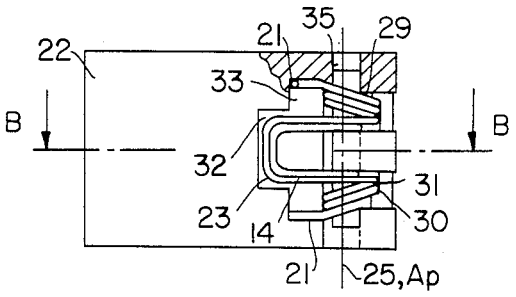
FIG. 3 is a top plan view in the direction of one of the vanes with an installed spring biasing means taken in the direction of the arrow X is FIG. 2.
Figure 4:
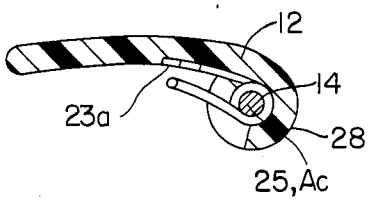
FIG. 4 is a sectional view taken on lines 4—4 through the vane illustrated in FIG. 3.

As best illustrated in FIGS. 2, 3 and 4, a helical spring 14 is mounted between each vane and rotor 7. The spring 14 functions to elastically urge the free end of the vanes radially outwardly against the bore surface 6 of the housing so that the free ends slide along the bore of the bell section 3 in sealing relation therewith. Spring 14 may be made of spring wire or comparable material. When rotor 7 turns in the direction directed by the arrow 15 in FIG. 2, air is drawn in through inlet port 16 to bell section 3 and allowed to escape in a conventional manner through an outlet 3*a* in cover section 4. Inlet port 16 as best illustrated in FIG. 1 is connected to an intake valve 17 attached to the bell section 3. The sliding surfaces of rotor 7 rotating in pump chamber 20 are lubricated through a central supply bore 18 in shaft 9 having radial connecting passages 19.

Considering more specifically the spring mounting arrangement and the spring with its two support ends 21 pointing in the direction of the free end of vane 12, each spring 14 contacts the inner surface 22 of vane 12 and is braced at its bail section 23 against a cylindrical support surface 24 formed in rotor 7. The central axis 25 of the spring turns extend in the direction or is aligned with the pivot axis $A_p$ of vane 12 and in the present instance axis 25 coincides with the pivot axis $A_p$ of the vane 12.

The pivot axis $A_p$ of each vane 12 is also formed by the central axis $A_c$ of a cylindrical section 28 which extends beyond the inner surface 22 of vane 12 and engages in a form locking manner in a cylindrical recess 27 in rotor 7. The cylindrical section 28 as illustrated is formed adjacent the end of the vane pivotally connected to the rotor. In this fashion each vane 12 is supported on the rotor 7 so that it can pivot and slide by means of this cylindrical section 28.

The spring 14 as best illustrated in FIG. 3 comprises two coaxial sections of turns 29 and 30 having, in the present instance, three turns which spiral in opposite directions. The spring sections 29 and 30 at one terminal outer end define support ends 21 which extend in a common direction parallel to one another. A so-called bail section 23 connects the spring turn sections 29 and 30, the bail 23 projecting radially beyond the turn sections 29 and 30. In this fashion the bail section 23 connects the inner ends of the spring turn sections 29 and 30 rigidly together. The turn sections 29 and 30 of each spring 14 are inserted in each case into a recess 31 in cylindrical section 28 of vane 12. These recesses 31 tightly enclose the spring turn sections 29 and 30 to hold them in place.

As best illustrated in FIG. 4, the inner surface of each vane has a recess 32 defining a pocket 23*a* for receiving the bail section 23 so that it points in the direction of the free end of the vane 12 and is braced thereby. As illustrated in FIG. 3, the recess extends along bail section 23 generally in the shape of an arc and opens laterally into recess 31 in vane 12. The inner surface of each vane also has a pair of recesses 33 located radially opposite the support end 21 of spring 14. These recesses 33 are of a predetermined depth so that the support ends 21 project radially beyond rotor 7 can be completely received or accommodated in these recesses 33 when vane 12 pivots into position. A locating pin 34 engageable in the spring turn sections 29 and 30 of each spring 14 aligns the spring sections concentrically. The pin is mounted in retention holes 35 in vane 12.

Figure 5:
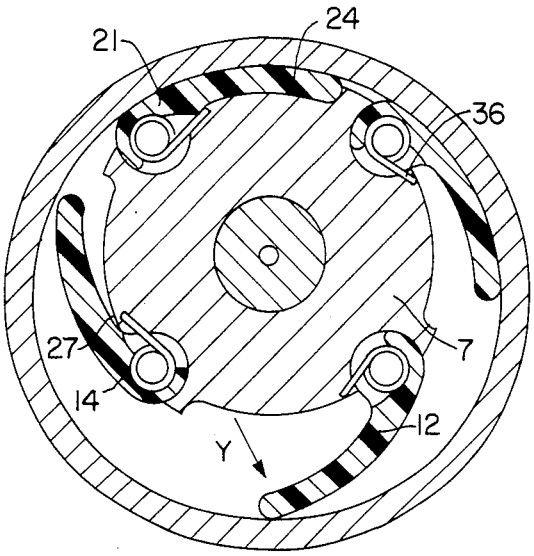
FIG. 5 is a sectional view through a modified rotary vane pump in accordance with the present invention.
Figure 6:
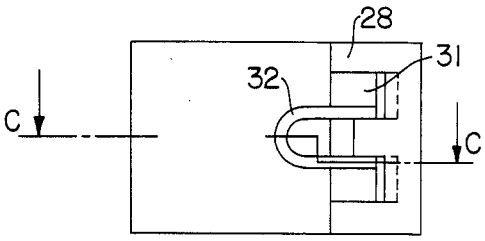
FIG. 6 is a top view of a vane with the spring removed as viewed in the direction of the arrow Y in FIG. 5.
Figure 7:
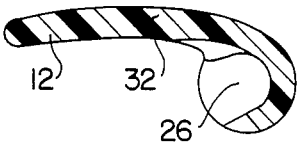
FIG. 7 is a sectional view taken on lines 7—7 of FIG. 6

There is illustrated in FIGS. 5, 6 and 7 a modified rotary pump in accordance with the present invention. This embodiment is generally similar to the pump shown in FIGS. 1–4. However, in this instance, the spring turn sections 29 and 30 are not supported by means of a locking pin but are aligned and held in place simply by the boundary walls of the recess 27 in rotor 7 and/or recess 31 in vane 12. Further, a groove-like channel 36 is machined into support surface 24 of rotor 7 for each support end 21 of spring 14. The channel 36 holds the support end 21. Since the support ends 21 do not project radially beyond support surface 24, in the present instance, there is no need for channels or recesses machined in the vanes 12 for holding the sections in place.

Figure 8:
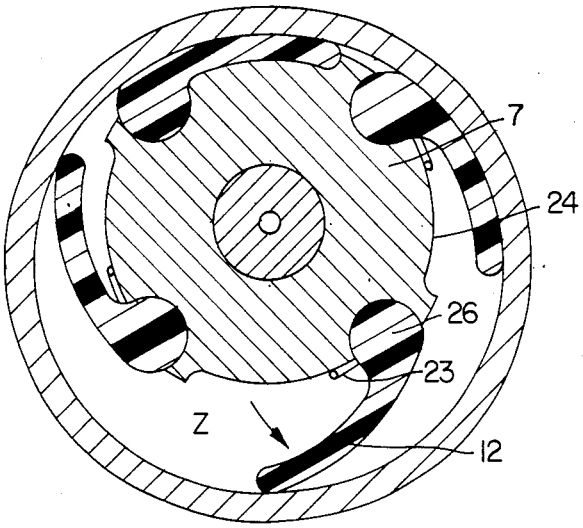
FIG. 8 is a sectional view through a further modified rotary pump in accordance with the present invention.
Figure 9:
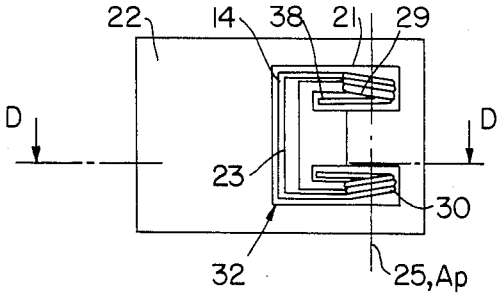
FIG. 9 is a top plan view of a vane with an installed biasing spring taken in the direction of the arrow Z in FIG. 8.
Figure 10:
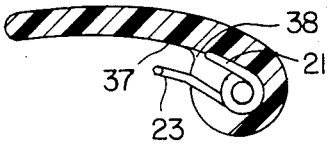
FIG. 10 is a sectional view taken on lines 10—10 of FIG. 9.

A still further modification of a rotary pump in accordance with the present invention is illustrated in FIGS. 8, 9 and 10. The basic configuration and principle of operation of the pump are generally the same as the previously embodiment. Note that the actuating springs 14 have two coaxial turn sections 29 and 30 which spiral in opposite directions and wherein the axis 25 of the turns of each spring extends in the direction of the pivot axis $A_p$ of vane 12 and is coincident therewith. In the present instance, however, the two support ends 21 are located at the inner end of the sections of turns 29 and 30 and the bail section 23 pointing in the direction of the free end of vane 12 is located adjacent the outer ends of the turn sections 29 and 30. By this arrangement, bail section 23 connects the outer ends of the two sections of turns 29 and 30 rigidly together. The bail section 23 projects radially beyond the turn sections 29 and 30 and is supported on cylindrical support surface 24 of rotor 7 in the radial direction whereby it projects radially beyond support surface 24.

The inner surface 22 of vane 12 has a channel-like recess 37 which is radially opposite bail section 23 and which at its outer terminal end opens into a connecting channel in the cylindrical section 28 of vane 12. Channel 37 is of a predetermined depth so that the bail section 23 can be completely recessed therein when vane 12 pivots against rotor 7 as rotor 7 rotates. Inner surface 24 is also provided with channels 38 for support end 21 of spring 14. Note that support end 21 is braced against the base of the recess 38.

Even though particular embodiments of the present invention have been illustrated and described herein, it is not intended to limit the invention and changes and modifications may be made therein within the scope of the following claims. For example, the vanes do not have to be mounted for pivotal movement by means of a cylindrical chamber in the rotor wherein a complementary cylindrical section of the vane can slide. Instead the configuration may be concave, e.g. spherical to receive a correspondingly curved, convex section of the vane for sliding movement as the main pivots. In this instance, the pivot axis is held parallel to the rotational axis of the rotor by the free ends of the vanes so that the free ends can slide in the bore of the housing and thus align the vanes. Further, the attachment ends of the vanes can be connected pivotally by way of rolling elements or roller bearings to the rotor.

What is claimed is a:

1. Rotary pump comprising a housing having a bore, a driven rotor mounted in said bore housing having a first support surface (24), vanes having a second inner support surface (22) pivotably connected at one end to the periphery of the rotor, said vanes having a pilot axis parallel to the axis of rotation of the rotor and helical springs, acting on an inner surface of the vanes operable to press the free end of the vanes opposite said one end against the housing bore, each spring (14) has an axis (25) whose turns extend in the direction of the pivot axis of the vane (12) and coinciding therewith, is installed in each vane (12) and is formed by two spaced coaxial sections of turns (29, 30) which spiral in opposite directions, each section of turns having a support end (21) and a bail section (23) between the ends of the two sections of turns (29, 30), said bail section connecting the ends of said sections of turns (29, 30), said bail section (23) operable to elastically press on said second inner support surface, and said support ends (21) pointing toward the free end of the vane (12) elastically pressing against said first support surface.

2. Rotary pump according to claim 1, wherein the pivot axis of each vane (12) is formed by a cylinder axis (26) of a cylindrical section (28), which is held pivotably in a cylindrical recess (27) in the support surface (24) of the rotor (7); and where the two sections of turns (29, 30) of spring (14) are held in each case in a recess (31) in the cylindrical section (28), which tightly encloses the associated section of turns (29, 30).

3. Rotary pump according to claim 1, wherein the inner surface (22) of the vane (12) has at least one recess (32, 33, 37, 38) which hold the support ends (21) and the bail section (23) of the spring (14).

4. Rotary cell pump according to claim 1, wherein the support surface (24) of the rotor (7) has at least one recess (36), which hold the support ends (21) and the bail section (23) of the spring (14).

5. Rotary pump as claimed in claim 1, including means for lubricating said rotor comprising a central supply bore in a shaft member supporting the rotor for rotation having radial connecting passages.

6. Rotary pump according to claim 1 wherein a pin (34), which concentrically aligns the sections of turns (29, 30) and which can be inserted into a corresponding retaining recess (35) in the associated vane (12), is installed in the area inside the two sections of turns (29, 30).

* * * * *